US007472847B2

(12) United States Patent
Mukai et al.

(10) Patent No.: US 7,472,847 B2
(45) Date of Patent: Jan. 6, 2009

(54) FLUIDIC DEVICE

(75) Inventors: Hiroshi Mukai, Ishioka (JP); Keiichi Honma, Asahi (JP); Takeshi Honda, Chiyoda (JP); Tetsuo Kimiya, Nakajo (JP)

(73) Assignee: Hitachi Industrial Equipment System Co., Chiba-shi (JP)

( * ) Notice: Subject to any disclaimer, the term of this patent is extended or adjusted under 35 U.S.C. 154(b) by 561 days.

(21) Appl. No.: 10/736,544

(22) Filed: Dec. 17, 2003

(65) Prior Publication Data

US 2004/0195398 A1 Oct. 7, 2004

(30) Foreign Application Priority Data

Mar. 19, 2003 (JP) ..... 2003-074754

(51) Int. Cl.
*B05B 1/08* (2006.01)

(52) U.S. Cl. ..... 239/589.1; 239/DIG. 3; 137/826; 137/811; 454/152

(58) Field of Classification Search ..... 239/589.1, 239/589, DIG. 3; 137/826, 834, 833; 454/125, 454/152

See application file for complete search history.

(56) References Cited

U.S. PATENT DOCUMENTS 3,016,066 A * 1/1962 Warren ..... 137/836
3,148,691 A * 9/1964 Greenblott ..... 137/815
3,283,767 A * 11/1966 Wright ..... 137/834
3,294,103 A * 12/1966 Bowles ..... 137/838
3,358,577 A * 12/1967 Thomson ..... 454/320
4,167,873 A * 9/1979 Bahrton ..... 73/861.19
4,596,364 A * 6/1986 Bauer ..... 239/589.1
4,694,992 A * 9/1987 Stouffer ..... 239/265.23
RE33,159 E * 2/1990 Bauer ..... 239/589.1
5,524,660 A * 6/1996 Dugan ..... 137/14

FOREIGN PATENT DOCUMENTS

JP 10-052654 2/1998
JP 2001-062354 3/2001

OTHER PUBLICATIONS

32nd Fluid Dynamics Lecture Meeting by Aerospace Institute and Fluid Dynamics Institute, "Self-Induced Oscillation of a Jet Issued from a Flip-Flop Jet Nozzle" Oct. 2000.

* cited by examiner

*Primary Examiner*—Dinh Q Nguyen
(74) *Attorney, Agent, or Firm*—Antonelli, Terry, Stout & Kraus, LLP.

(57) ABSTRACT

For achieving a fluidic device, being able to be made small in sizes, comprising a fluid inflow opening 1, a connector duct 2, and a fluid jet nozzle, wherein the connector duct 2 is constructed with curves, and is further constructed with two (2) pieces of flow passages, being symmetric on both sides. Constructing the connector duct with the curves reduces resistance of fluid within the duct, and further dividing the connector duct into two (2) parts in both side enhances the flows at confluent point in the duct (increase of the flow velocity).

20 Claims, 15 Drawing Sheets

FLUIDIC DEVICE

BACKGROUND OF THE INVENTION

The present invention relates to an apparatus, such as, a sprinkler for fluctuating or changing the velocity of fluid flowing out from a nozzle at a specific cycle or period, for example.

In general, for the purpose of changing the velocity of fluid flowing out from a nozzle, the velocity is controlled by changing the configuration of the flow passage in the vicinity of the nozzle, there by changing an orbit of the fluid jetting out from the nozzle. In particular, as the structure for controlling the fluid, without using an electric driving mechanism, etc., a mechanism is used, such as, a nozzle for use of a jet bath (see Patent Document 1) or a pulse air jet generating device (see Patent Document 2), for example.

Each of those comprises a mechanism to be driven through hydraulic power in the vicinity of the position of flow-out in the nozzle, where in the configuration of the flow passage is changed through movement of the mechanism with an aid of function of the hydraulic power; i.e., a mechanism for controlling the velocity by changing the orbit of fluid.

Other than this, there is already known a means, such as, a flip-flop nozzle (see Non-Patent Document 1), in which the velocity of fluid can be varies without changing the configuration of flow passages.

In this, a moving direction of fluid is changed with using a pressure difference caused by the fluid jetting out from the nozzle portion. With applying the structure of switching over the pressure difference due to the change in the moving direction of fluid, the moving direction of fluid is changed, and repetition of this enables to change or oscillate the flow velocity at a specific period.

Patent Document 1

Japanese Patent Laying-Open No. 2001-62354(2001), "NOZZLE DEVICE FOR JET BATH USING NOZZLE DEVICE", pp 9-11;

Patent Document 2

Japanese Patent Laying-Open No. Hei 10-52654 (1998), "PULSE AIR JET GENERATING DEVICE", p 9; and Non-Patent Document 1

32$^{nd}$ Fluid Dynamics Lecture Meeting by Aerospace Institute and Fluid Dynamics Institute, "Self-Induced Oscillation of a Jet Issued from a Flip-Flop Jet Nozzle".

However, if trying to change the flow velocity by changing the configuration of flow passage, as is taught in the Patent Documents 1 and 2 mentioned above, there are following problems can be listed up:

First, because a portion of energy that the fluid has is used as energy for driving the mechanism, therefore a loss of energy is increased, thereby lowering the flow velocity;

Second, due to movement of the mechanism, there is a possibility of generating dusts, in particular, from the bearing thereof, etc., thereby contaminating the fluid, therefore it is difficult to apply it into a facility for producing drags, foods, or into a clean room of high cleanness, etc.;

Third, maintenance is indispensable for the mechanism;

Fourth, a number of parts of the nozzle is increased for building up the mechanism, and also costs rise up due to the complicated manufacturing steps thereof; and Fifth, due to the problems, i.e., durability of the mechanism portion or the like, such as the bearing, etc., it is difficult to be applied into the conditions, such as, a fluid of high temperature or low temperature, a fluid of strong acid or strong alkaline, also into a gas contaminated with dusts and a water of rivers containing waste therein; i.e., it is restricted on the fluid to which the device can be applied.

On the contrary to this, with an example of the Non-Patent Document 1, since no movable mechanism is provided therein, there occurs no such the problem as mentioned in the above. However, because of the principle that a flow is generated within a connector duct by using the pressure difference generated in the nozzle portion, as driving force thereof, thereby reversing the pressure difference, there is a necessity of a certain amount of flow. Namely, for producing the flow amount with a little pressure difference, it is necessary to lower the flow resistance within the connector duct, and then the connector duct increases in the area of flow passage therein, therefore there is a problem that the device or apparatus comes to be large in the sizes, as a whole.

BRIEF SUMMARY OF THE INVENTION

Accordingly, the present invention relates to a technique for changing the velocity of fluid without using movable mechanism therein, and an object, according to the present invention, is to provide a fluid device enabling to oscillate with stability, even if it is small in the sizes thereof. For that purpose, according to the present invention, there is provided a fluidic device, comprising: a fluid inflow opening; a connector duct; and a fluid jet nozzle, wherein the fluid within said connector duct is driven by pressure difference at said fluid jet nozzle portion, being reversed in the pressure difference as a result thereof, and again being driven, thereby oscillating, and further said connector duct is constructed with a plural number of flow passages. Also, according to the present invention, in the fluidic device as described in the above, said connector duct is made of two (2) pieces of flow passages, being symmetric with each other, and said fluid inflow opening and said fluid jet nozzle are disposed in a center between those two (2) pieces of the of flow passages. And also, according to the present invention, in the fluidic device as described in the above, said connector conduct is constructed with a curved surface, or a wind guiding plate is provided within said connector duct.

With such the structure as was mentioned above, the resistance is lowered against fluid within the connector duct, and the flow passing within the dust is strengthened or enhanced, therefore there can be achieved the fluidic device being able to oscillate with stability, if being made small in the sizes thereof.

BRIEF DESCRIPTION OF THE SEVERAL VIEWS OF THE DRAWING

Those and other objects, features and advantages of the present invention will become more readily apparent from the following detailed description when taken in conjunction with the accompanying drawings wherein.

DETAILED DESCRIPTION OF THE INVENTION

Hereinafter, embodiments according to the present invention will be fully explained by referring to the attached drawings.

Figure 1:
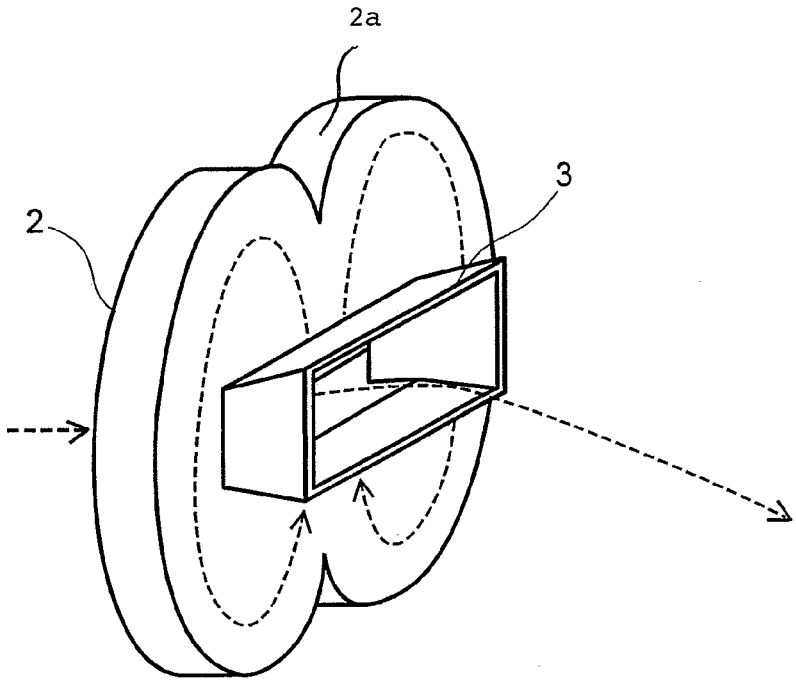
FIG. 1 is a perspective view of a fluidic device, according to one embodiment of the present invention.

FIG. 1 is a perspective view of a fluidic device, according to one embodiment of the present invention.

Figure 2:
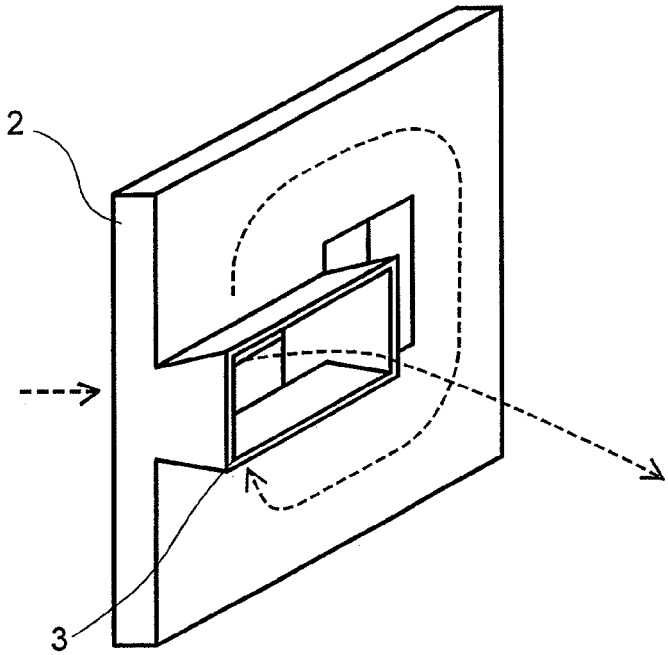
FIG.2 CONVENTIONAL ART
FIG. 2 is a perspective view for showing a conventional fluidic device, which is described in the Non-Patent Document 1mentioned above.

FIG. 2 is a perspective view for showing a conventional fluidic device, which is described in the Non-Patent Document 1 mentioned above.

Figure 3:
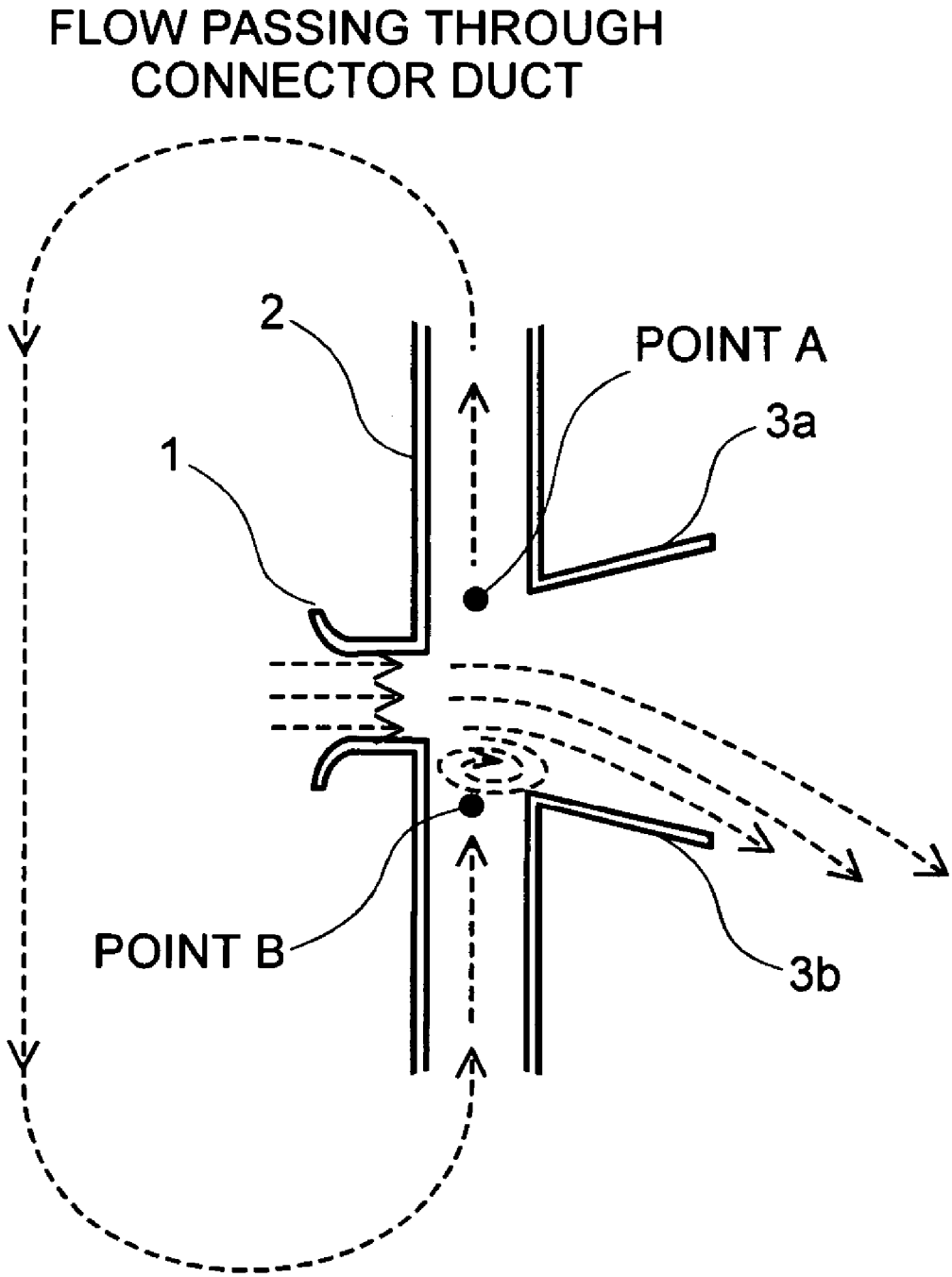
FIG. 3 is a cross-section view of the fluidic device.

FIG. 3 is a cross-section view for explaining those nozzle portions.

In those FIGS. 1, 2 and 3, the fluidic device is constructed with a fluid inflow opening 1, a connector duct 2 having a wind guiding plate 2*a* in the form of a curved surface, and a fluid jet nozzle 3 (in FIG. 3, an upper plate of the nozzle is indicated by 3*a* and a lower plate by 3*b*, respectively, for convenience). Broken lines in the figure indicate flows of the fluid.

Operation of the present fluidic device will be shown below.

The fluid flowing into from the fluid inflow opening 1 comes across the connector duct 2, and it reaches to the fluid jet nozzle 3, thereby being flown out from the nozzle, however in this instance, according to the character of the fluid, it flows out along with either one of the upper plate 3*a* and the lower plate 3*b*.

As shown in FIG. 3, i.e., in a case when the fluid flows out along with the lower plate 3*b*, an eddy or swirl is generated in the vicinity of a point B, and it is in the condition of the pressure, being lower than that in the vicinity of a point A. As a result of this, flow is generated from the point A through the connector duct to the point B. With this flow, the pressure difference between the points A and B is lowered down, gradually, thereby falling down to zero (0), however the flow within the connector duct continues flowing due to the inertia thereof, and as a result, the pressures at the points A and B are reversed or switched over. Accompanying this, main flow flowing along with the lower plate 3*b* peels or comes off therefrom, and then it turns to flow along with the upper plate 3*a*. Thereafter, the flow flowing within the connector duct is also reversed according to the pressure difference, and now, it begins to flows directing from the point B to the point A within the connector duct. Automatic repetition of such the operation as was mentioned above produces the flow that changes the flow velocity thereof at a certain period.

For the purpose of bringing such oscillating operation to be obtained with stability, it is necessary to reduce the resistance in the flow passage in the connector duct, and also to strengthen or enhance the flow flowing out to the points A and B from the connector duct. For that purpose, in one embodiment shown in FIG. 1, the connector duct 2 is built up with curves, and further, it is constructed with two (2) pieces of flow passages, being symmetric to each other in both sides. Thus, constructing the connector duct 2 with the curves reduces the fluid resistance within the duct, and further dividing of the connector duct 2 into both sides achieves the strengthening or enhancement of the flow at a confluence of the duct (i.e., an increase of the flow velocity).

Figure 4:
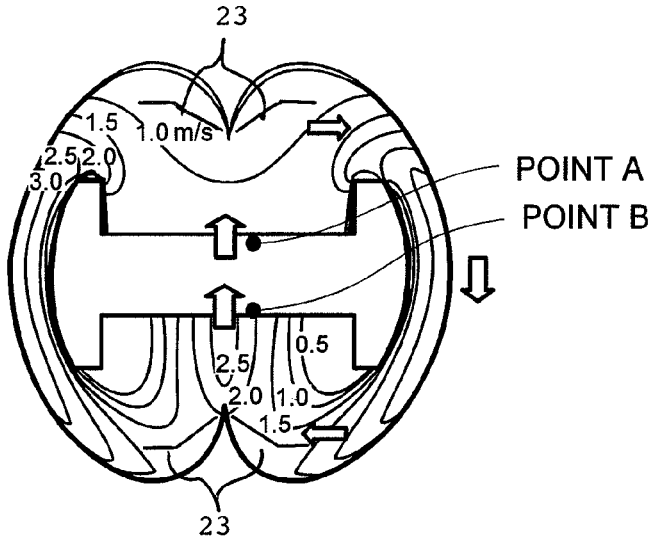
FIG. 4 shows a result of simulation on the fluidic device, according to the embodiment of the present invention.
Figure 5:
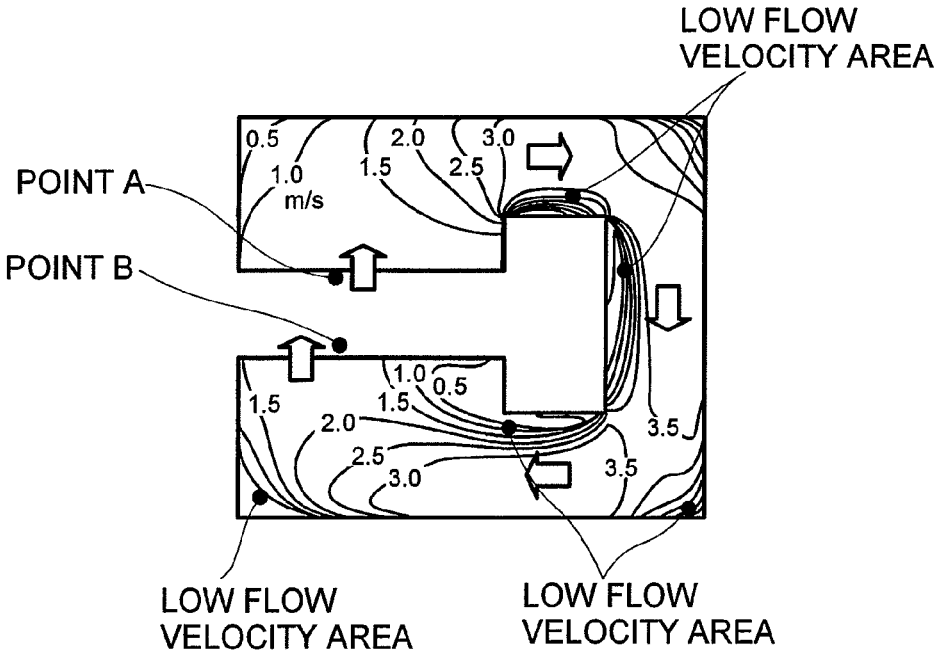
FIG.5 CONVENTIONAL ART
FIG. 5 shows a result of simulation on the conventional fluidic device, which is shown in FIG. 2 mentioned above.

FIGS. 4 and 5 show distribution of the flow velocities on a cross-section within the connector duct 2 having guide vanes 23, which are obtained through a simulation on the flows, being indicated by contour lines, and in particular, FIG. 4 shows that obtained in the connector duct according to the present invention, while FIG. 5 that obtained in the connector duct of the conventional connector duct.

As to the condition thereof, there is shown the distribution of flow velocities when the flow flows in from the point A at a constant velocity (1 m/s, for example).

Within the connector duct shown in FIG. 4, according to the present invention, no large stagnation is generated covering over the flow passage as a whole, however in the connector duct shown in FIG. 5 relating to the conventional art, there are several regions of low flow velocity, where the flows are stagnated, and therefore it is clear that the resistance is large in the flow passage within the connector duct. Also, checking the maximum flow velocity at the point B, the flow velocity is generated, being higher than 2.5 m/s due to the effect of the confluence, in FIG. 4, however in FIG. 5, the flow velocity stays within the flow velocity of about 2 m/s. As was mentioned in the above, according to the present invention, since the resistance is reduced in the flow passage within the connector duct, and the flow flowing out from the point A to the point B is enhanced, therefore it is possible to achieve the fluidic device, oscillating with stability if being made small in the sizes thereof.

Next, other embodiment according to the present invention will be explained, by referring to FIGS. 6 and 7.

Figure 6:
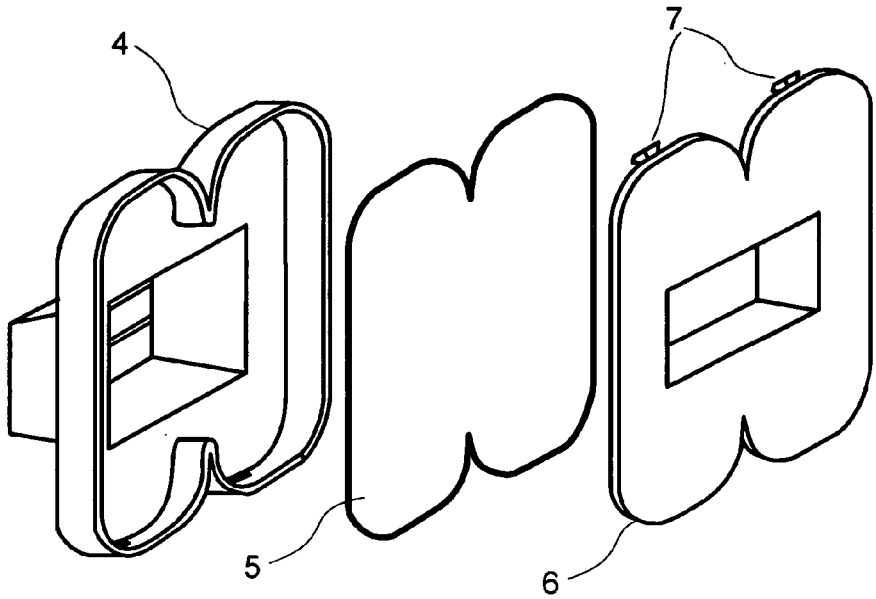
FIG. 6 is a perspective view for explaining the constituent elements of the present embodiment.

FIG. 6 is a perspective view for explaining the configuration parts of the fluidic device, according to the present invention.

Figure 7:
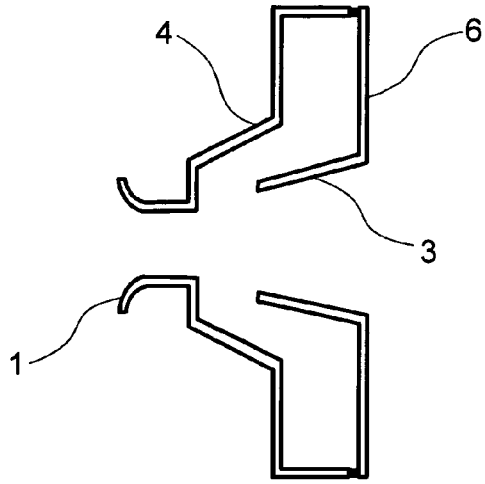
FIG. 7 is a cross-section view for showing the condition of building up the constituent elements, shown in FIG. 6.

FIG. 7 is a cross-section view for explaining the condition where the parts shown in FIG. 6 are assembled or built up.

In FIGS. 6 and 7, the connector duct is divided into two (2) in the structure thereof, wherein the fluid inflow opening 1 is formed on a reverse plate 4 of the connector duct, and the fluid jet nozzle 3 in a front plate 6 of the connector duct, respectively, with a space being delimited between the reverse plate 4 and the front plate 6. The reverse plate 4 and the front plate 6 of the connector duct are sealed up with putting packing 5 between them, and they are fixed by means of a ratchet 7 for use of attachment, in the structure thereof. With such the structure as was mentioned above, the present fluidic device can be constructed with only three (3) pieces of the constituent parts.

Figure 8:
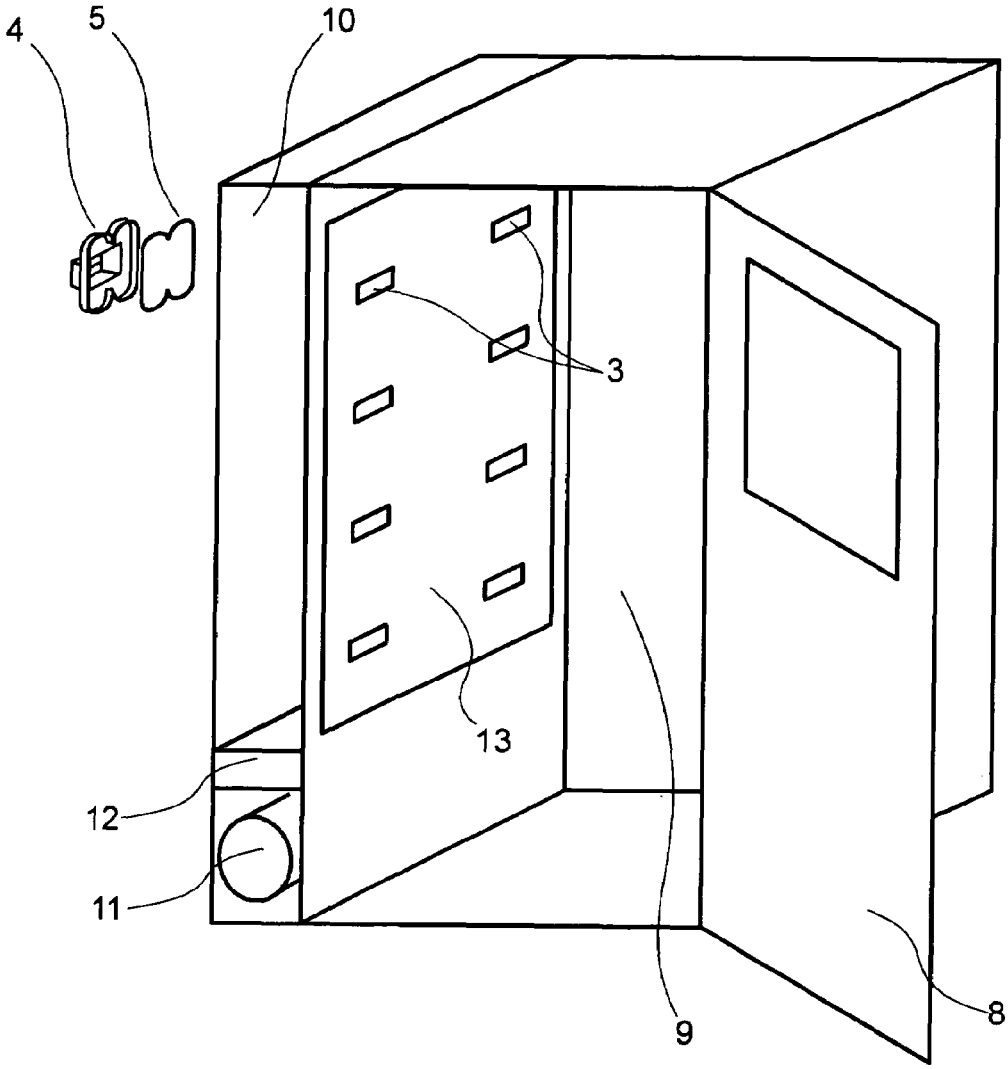
FIG. 8 is a perspective view for showing an embodiment, in which the fluidic device is applied into an air shower apparatus, according to the present embodiment.

FIG. 8 shows the embodiment, in which the fluidic device, according to the present invention, is applied into an air shower.

In FIG. 8, a target person enters from an inlet door 8 into a shower room 9, and conducting dust removing on her/himself. A reference numeral 10 is a pressurizing chamber, wherein a gaseous body is sent therein through a filter 12 by means of an air blower 11 in the structure thereof. The pressurizing chamber 10 and the shower room 9 are shut off by means of a pressure partition wall 13. On the pressure partition wall 13, in particular, on the side of plural number of the fluid jet nozzles 3 and the pressurizing chamber 10, there are formed ratchets 7 for use of attachment, and the reverse plate 4 of the connector duct is attached thereon through the packing 5, in the structure. In this manner, since the fluid jet nozzles 3 are formed on the pressure partition wall 3, in the structure thereof, it is possible to reduce the number of the parts, greatly. And, it is also possible to conduct disassembling and/or cleaning thereon, easily.

Next, further other embodiment according to the present invention will be explained, by referring to FIGS. 9 and 10.

Figure 9:
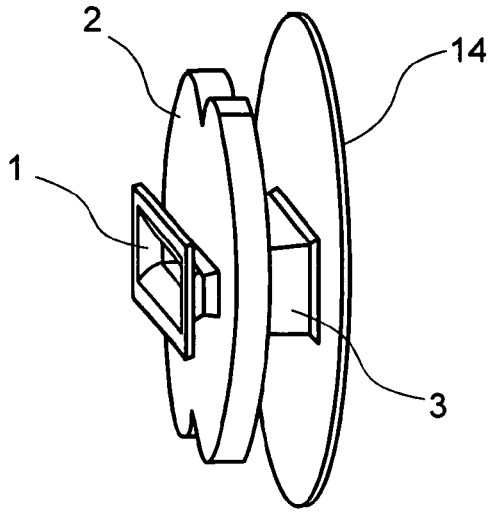
FIG. 9 is a perspective view of the fluidic device, according to other embodiment of the present invention.

FIG. 9 is a perspective view of the fluidic device, according to other embodiment of the present invention.

Figure 10A:
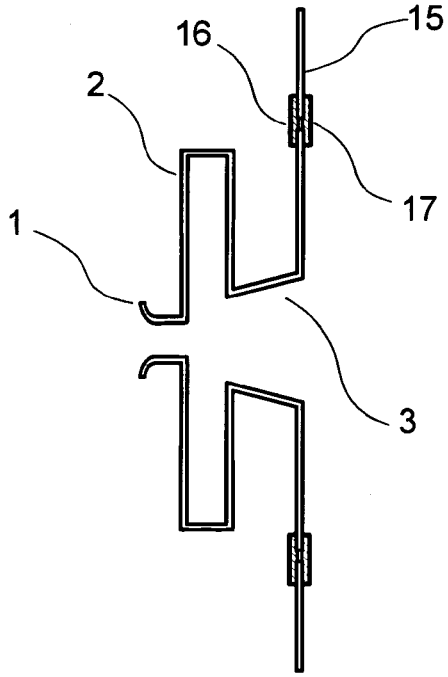
FIGS. 10(A) and 10(B) area cross-section and a partial front view of the fluidic device shown in FIG. 9, under the condition of being attached.
Figure 10B:
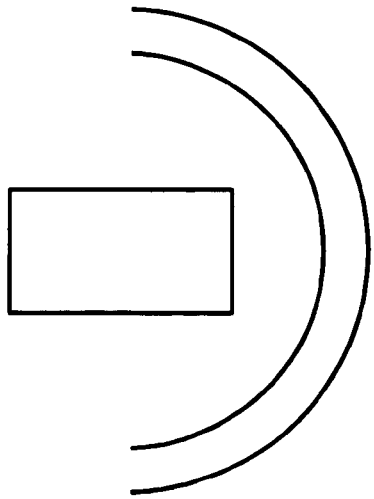

FIGS. 10(A) and 10(B) are a cross-section view, including a partial front view, for explaining the condition where the fluidic device shown in FIG. 9 is attached.

In those, FIGS. 9 and 10(A) and(B), a circular partition 14 is provided at an outlet portion of the fluid jet nozzle 3. A reference numeral 15 is an object of the attachment, such as, the pressure partition wall of the air shower apparatus, for example. Reference numerals 16 and 17 are attachment parts, and they are fixed by putting the partition wall 14 between them from both sides, so that the partition wall 14 can be rotated freely.

Figure 11:
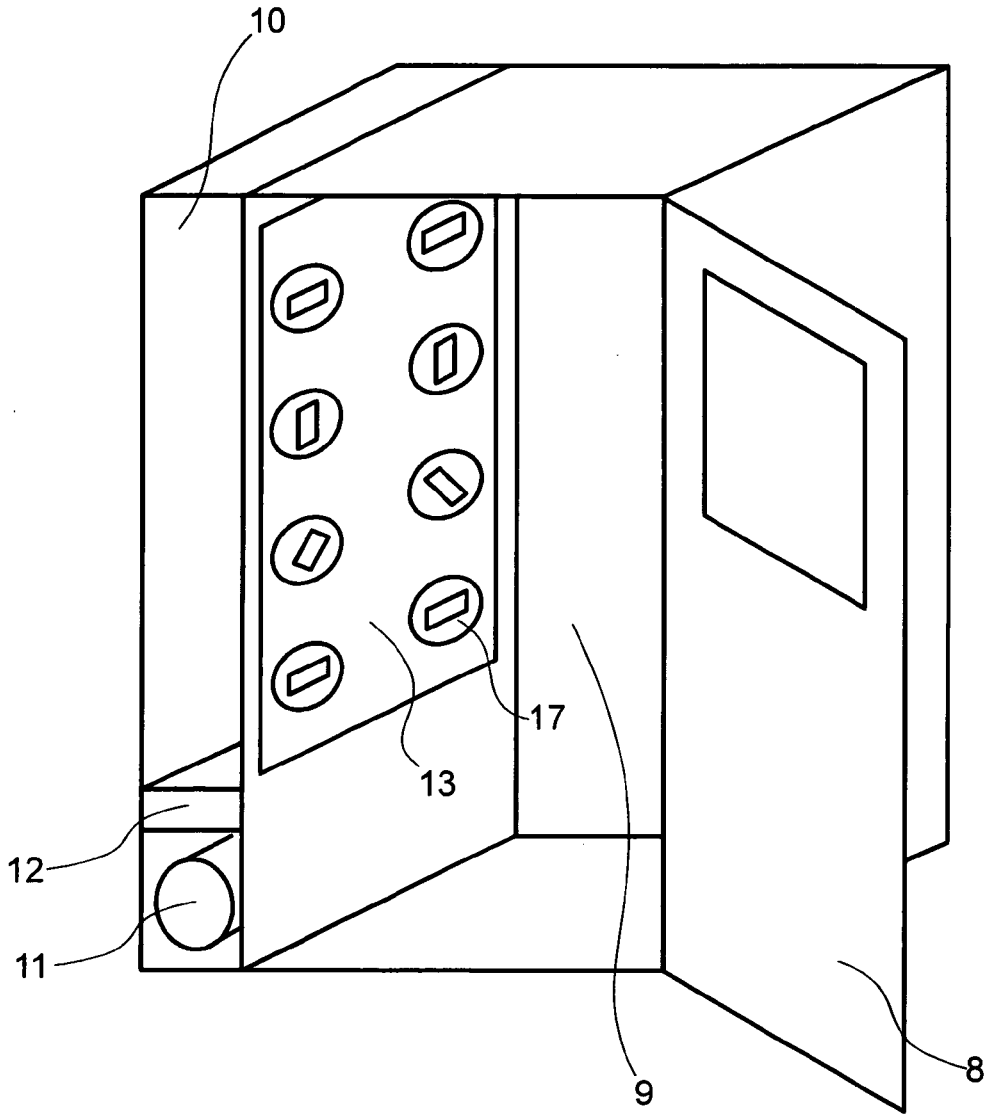
FIG. 11 is a perspective view for explaining the condition where the fluidic device shown in FIG. 9 is applied to the air shower apparatus.

FIG. 11 shows an embodiment, in which the fluidic device according to the present invention is applied, wherein a reference numeral 18 indicates the fluidic device. In the structure shown in FIG. 10, attaching the fluidic device on the pressure partition wall 13 enables a user to make an adjustment on the oscillating direction freely. Further, in the present embodiment, the jet nozzle 3 is positioned in the vicinity of a center of the partition wall 14, however it is also possible to dispose it at a position being eccentric therefrom.

Figure 12:
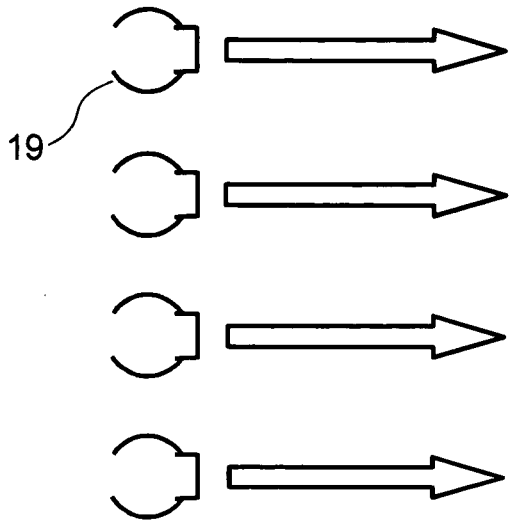
FIG.12 CONVENTIONAL ART
FIG. 12 is a view for showing distribution of airflows in the conventional air shower apparatus.
Figure 13:
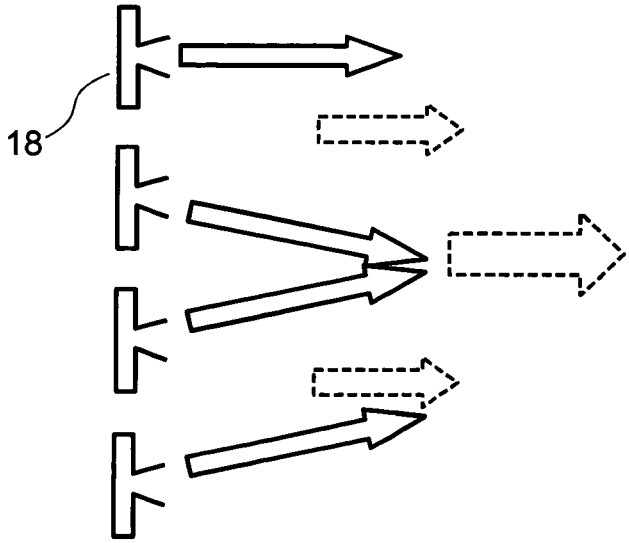
FIG. 13 is a view for showing distribution of airflows obtained with the fluidic device.

FIGS. 12 and 13 are views, wherein the distributions of air streams within the air shower apparatus by arrows, diagrammatically, targeting a plural number of the nozzles. FIG. 12 shows the distribution of air streams in the air shower apparatus relating to the conventional art, and FIG. 13 the distribution of air steams obtained by the fluidic device. As is shown in FIG. 12, the jet steam jetted from the conventional nozzle 19 is monotonic. On the contrary to that, in case of using the fluidic device as the nozzle, as is shown in FIG. 13, the flow jetting out from the each nozzle oscillates independently. Due to errors in manufacturing and also differences in the positions of attachments, the oscillating frequencies are different from one another, therefore the jet streams combine with each other depending on the timings, thereby obtaining a function of increasing the flow velocity thereof. Dust cleaning performance of the air shower apparatus has a proportional relation with the flow velocity, therefore improvement can be expected on the dust cleaning performance due to the synergetic effect of the oscillating jet streams.

Next, further other embodiment according to the present invention will be explained, by referring to FIGS. 14 and 15.

Figure 14:
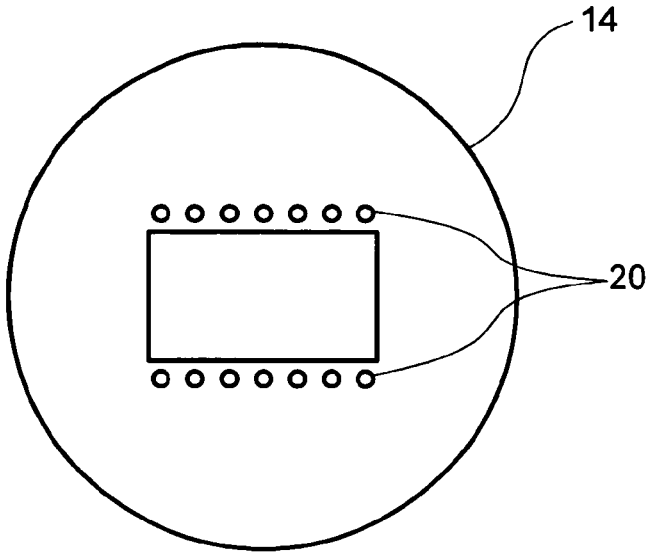
FIG. 14 is a front view of the fluidic device, according to other embodiment.

FIG. 14 shows a front view of the fluidic device, according to the further other embodiment.

Figure 15:
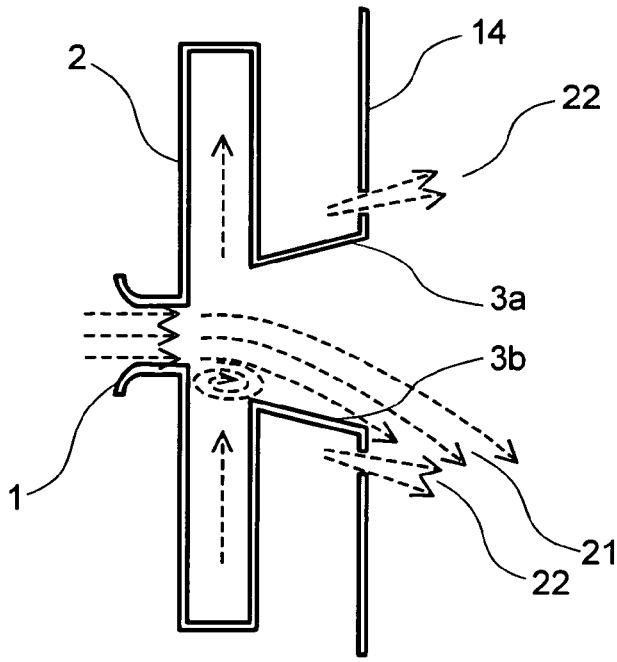
FIG. 15 is a cross-section view of the device shown in FIG. 14 mentioned above.

FIG. 15 is a cross-section view of the device shown in FIG. 14.

In those FIGS. 14 and 15, the device has such the configuration that a plural number of ventilating or air holes 20 are opened on the partition wall 14, in the vicinity of a nozzle upper plate 3*a* and a nozzle lower plate 3*b*. Thus, pressurizing the reverse side of the partition wall 14 as a whole (on the side of the fluid inflow opening 1) enables branches 22 to jet from the air holes 20, in addition to oscillating main flow 21 from the fluid jet nozzle 3. As a result of this, the main flow increases in the flow velocity, and thereby the jet reaches to far away. Also, there can be obtained an effect of clearing the fluid in the vicinity of the jet nozzle.

Figure 16:
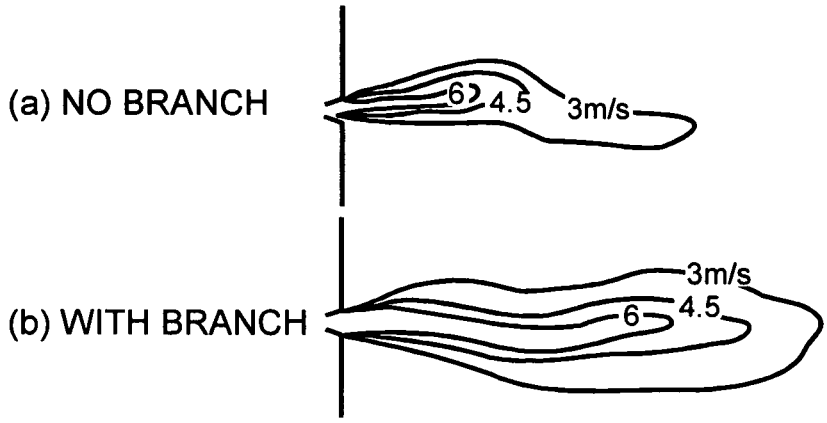
FIG. 16 is a view for showing a result of simulation on the fluidic device shown in FIG. 14 mentioned above.

FIG. 16 shows a simulation result on the jet stream under the condition where there are provided the branches 22 and where no such branch, and the distributions of the flow velocities are indicated by contour lines therein. It is apparent that a range of the jet stream is increased, due to the effect of the branches.

Next, further other embodiment according to the present invention will be explained, by referring to FIG. 18.

Figure 17:
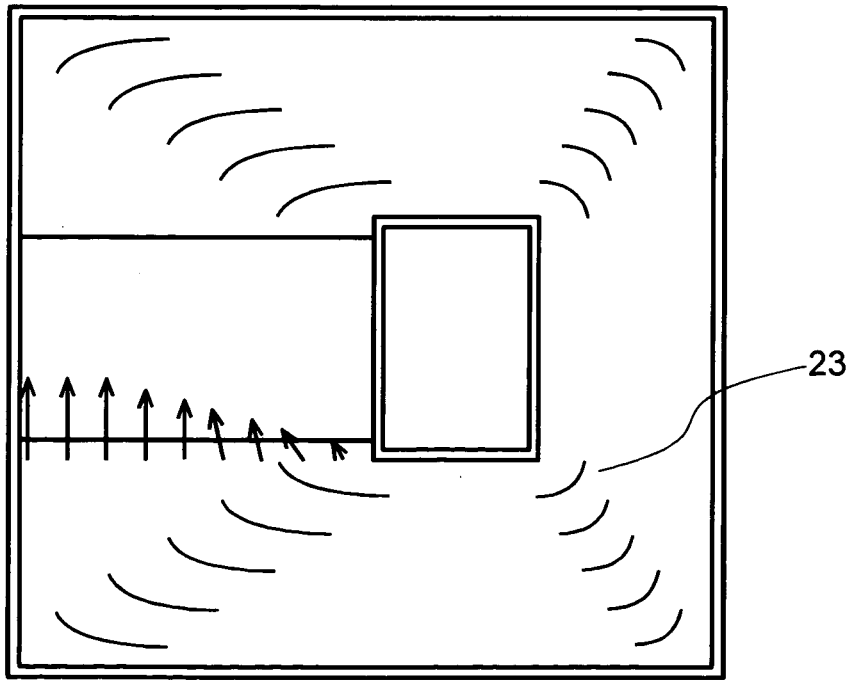
FIG.17 CONVENTIONAL ART
FIG. 17 is a cross-section view of a connector duct in the conventional fluidic device described in the Non-Patent Document 1 mentioned above.

FIG. 17 shows a cross-section view of a connector duct in the conventional fluidic device including guide vanes 23.

Figure 18:
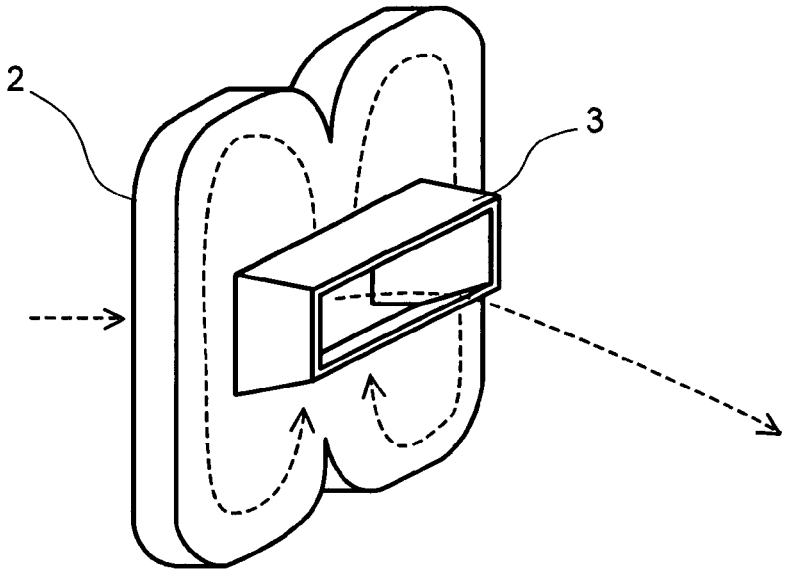
FIG. 18 is a perspective view of the fluidic device, according to other embodiment.

This FIG. 18 is a perspective view of the fluidic device, according to the further other embodiment.

Figure 19:
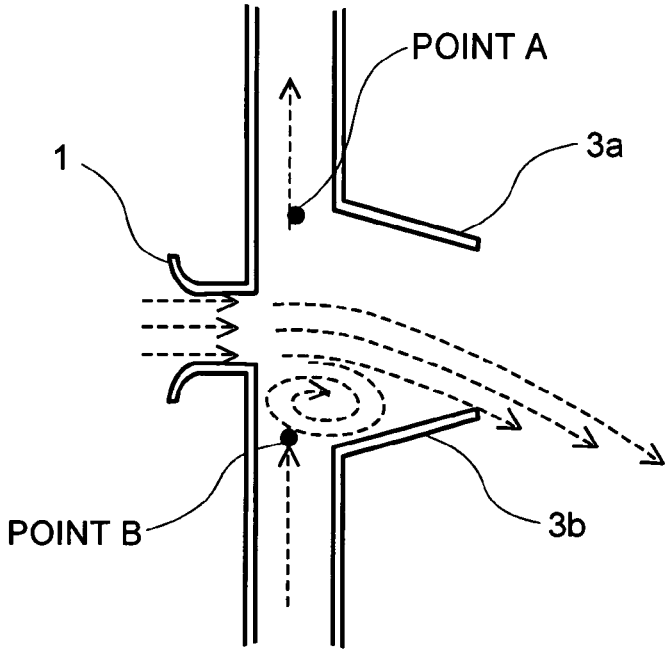
FIG. 19 is a cross-section view of the device shown in FIG. 18 mentioned above.

FIG. 19 is a cross-section view of the device shown in FIG. 18.

In those FIGS. 18 and 19, the feature according to the present embodiment lies in that, an opening angle of the nozzle portion is in minus, i.e., it is in a shape of being narrowed. As an effect of this, the volume is increased, being surrounded by the main flow and the nozzle lower plate 3*b* or the nozzle upper plate 3*a*, and therefore strong low pressure regions can be formed easily at the position of the point B or A, comparing to the nozzle having a plus opening angle, thereby stabilizing the oscillation.

Next, further other embodiment will be explained, by referring to FIGS. 20, 21 and 22.

In the present embodiment, means for stopping the oscillation of the fluidic device is indicated by an oscillation stoppage plate 24.

Figure 20:
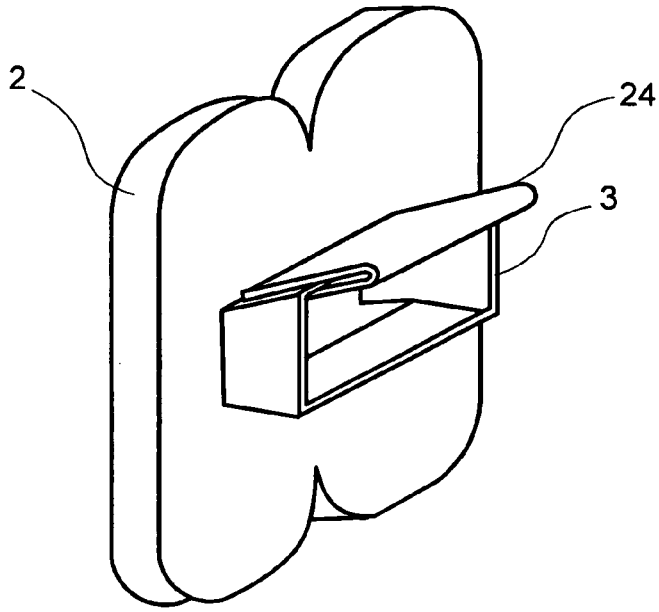
FIG. 20 is a perspective view of the fluidic device, according to other embodiment.

FIG. 20 is a perspective view of the fluidic device, according to the further other embodiment.

Figure 21:
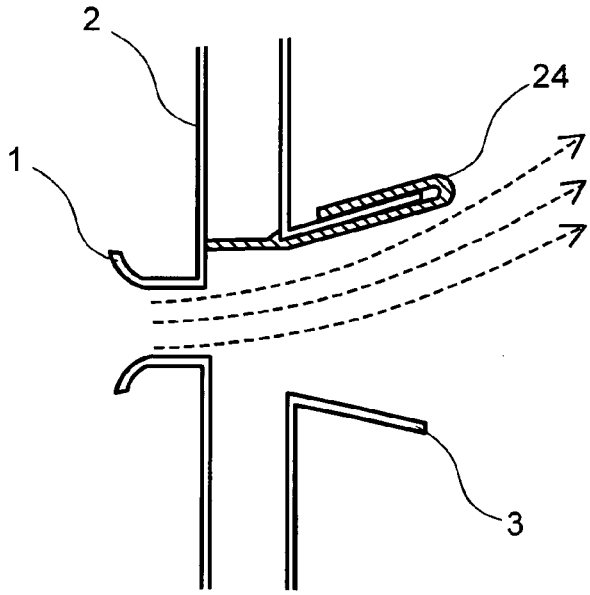
FIG. 21 is a cross-section view of the device shown in FIG. 20 mentioned above.

FIG. 21 is a cross-section view of the device shown in FIG. 20.

In those FIGS. 20 and 21, the oscillation stoppage plate 24 is formed from, for example, a metal or a resin, etc., and it has a certain degree of elasticity, and further has ratchets to be hand on the connector duct, thereby being fixed. Because the oscillation stoppage plate 24 is attached on the fluid jet nozzle 3, the connector duct 2 is closed, and as a result, the flow passing within the connector duct is blocked, therefore the oscillation is stopped. The jet shows a nature of flowing along with a wall surface nearest thereto, under the oscillation is stropped, therefore it sprouts out in the direction into which the oscillation plate 24 is attached, as shown in FIG. 21.

Figure 22:
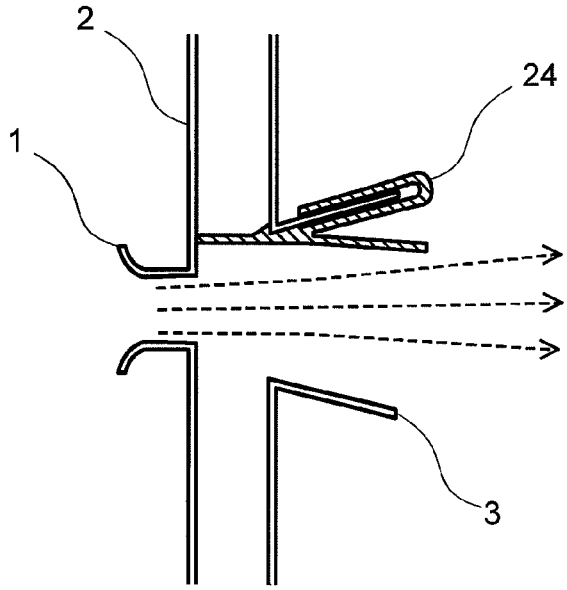
FIG. 22 is a cross-section view of the fluidic device according to another embodiment.

As is shown in FIG. 22, it is possible to control the direction of the jet stream by changing the configuration of the oscillation stoppage plate 24.

Next, further other embodiment according to the present invention will be explained, by referring to FIGS. 23(A) and 23(B).

In the present embodiment, means for controlling the oscillating frequency of the fluidic device is indicated by nozzle elongating plate 25.

Figure 23A:
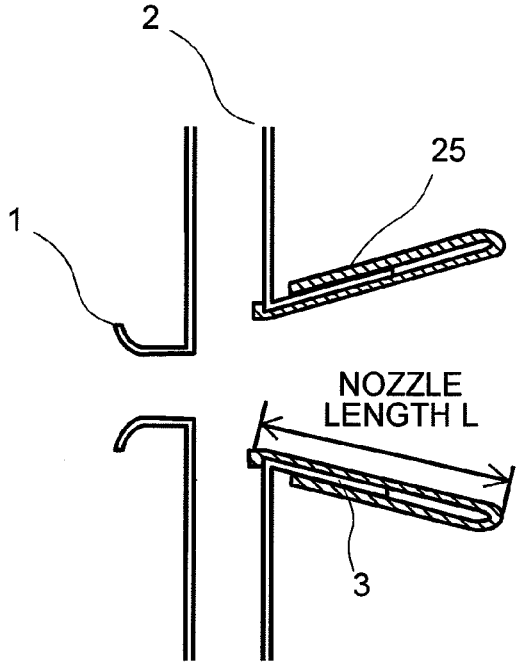
FIGS. 23(A) and 23(B) show a cross-section view of the fluidic device (attached with a nozzle elongating plate 25) according to the present invention, and a graph showing a characteristic thereof.
Figure 23B:
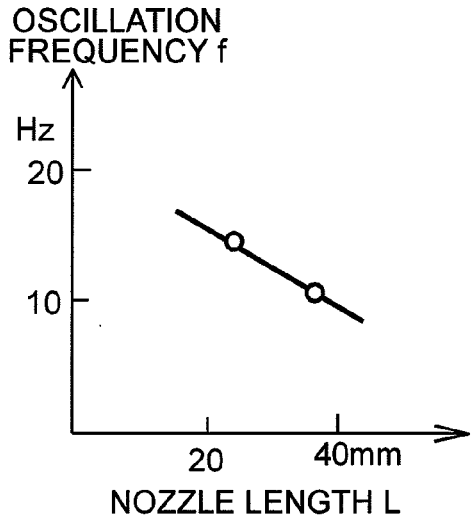

FIGS. 23(A) and 23(B) are cross-section views of the fluidic device, according to the further other embodiment.

In those FIGS. 23(A) and 23(B), there is shown the device under the condition where the nozzle elongating plate 25 is attached onto the fluid jet nozzle 3. The nozzle elongating plate 25 is formed from, for example, a metal or a resin, etc., and it has a certain degree of elasticity, and further has ratchets to be hand on the connector duct, thereby being fixed. As a nature of the fluidic device according to the present embodiment, since it has the nature of lowering the oscillating frequency accompanying with an increase of the nozzle length "L", therefore it is possible to control the oscillating frequency, freely, by adjusting the length "L" of the nozzle elongating plate 25.

Next, further other embodiment according to the present invention will be explained, by referring to FIGS. 24(A) and 24(B).

In the present embodiment, mans for controlling the oscillating frequency of the fluidic device is indicated by a nozzle opening angle control plate 26.

Figure 24A:
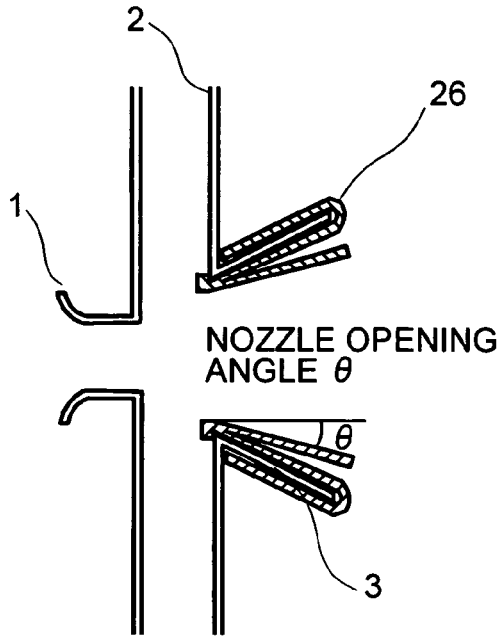
FIGS. 24(A) and 24(B) show a cross-section view of the fluidic device (attached with a nozzle opening angle control plate 26) according to the present invention, and a graph showing a characteristic thereof.
Figure 24B:
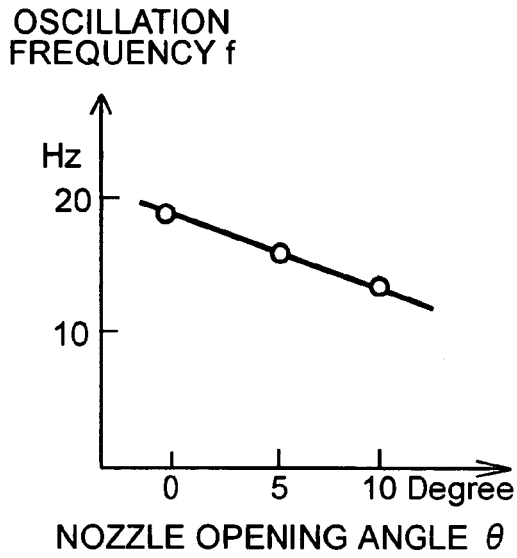

FIGS. 24(A) and 24(B) are cross-section views of the fluidic device, according to the further other embodiment.

In those FIGS. 24(A) and 24(B), there is shown the device under the condition where the nozzle opening angle control plate 26 is attached onto the fluid jet nozzle 3. The nozzle opening angle control plate 26 is formed from, for example, a metal or a resin, etc., and it has a certain degree of elasticity, and further has ratchets to be hang on the connector duct, thereby to be fixed. As a nature of the fluidic device according to the present embodiment, since it has a nature of lowering the oscillating frequency accompanying with an increase in the nozzle opening angle "θ", therefore it is possible to control the oscillating frequency, freely, by adjusting the angle "θ" of the nozzle opening angle control plate 26.

Next, further other embodiment according to the present invention will be explained by referring to FIGS. 25(A) and 25(B) and FIG. 26.

Figure 25A:
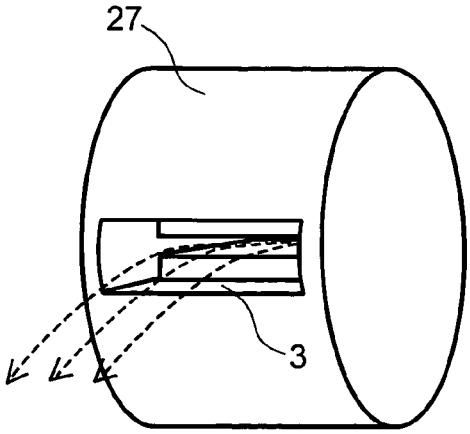
FIGS. 25(A) and 25(B) are perspective views fluidic devices (i.e., in a cylindrical case, and in a spherical case), according to the embodiment.
Figure 25B:
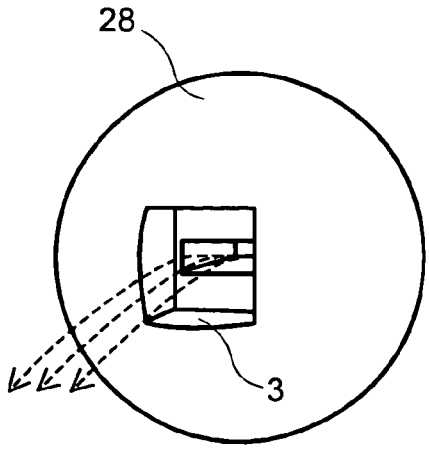

FIGS. 25(A) and 25(B) show the fluidic device according to the present invention, wherein a reference numeral 27 indicates the fluidic device according to the present invention, being installed within a cylindrical container, and a reference numeral 28 within a spherical container. Both devices 27 and 28 comprise the fluid inflow openings 1, the connector ducts 2, and the fluid jet nozzles 3, respectively, and oscillate in the similar manner as the fluidic device shown in FIG. 1 mentioned above.

Figure 26:
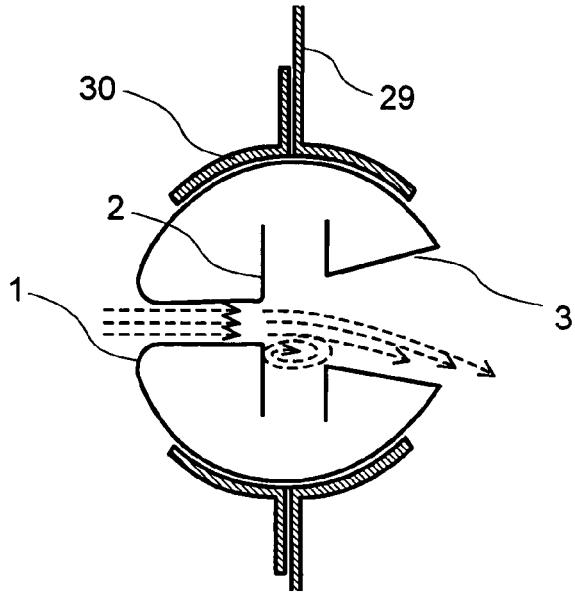
FIG. 26 is a cross-section view of a fluidic device according to the present invention describing the air shower apparatus of those shown in FIGS. 25(A) and 25(B) mentioned above.

FIG. 26 is a cross-section view of the device under the condition where it is attached to, such as, the air shower apparatus, for example, and a reference numeral 29 is a supporting plate, such as, the pressure partition wall 13 in the air shower apparatus, for example. A reference numeral 30 indicates a fixing plate, and it has such the structure of holding the fluidic device 27 or 28 with putting it between the supporting plates 29 and 30, under the condition of being freely rotatable.

With such the structure, it is possible to change the direction of the fluidic device 27 or 28, freely, even after attachment thereof.

Figure 27A:
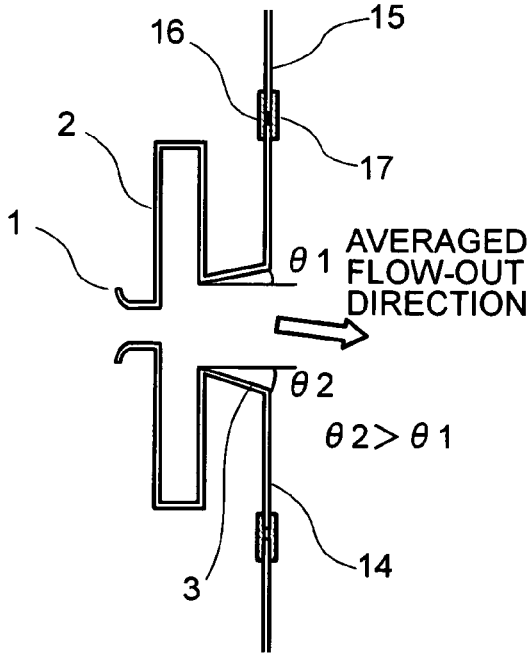
FIGS. 27(A) and 27(B) are cross-section views of the fluidic device according to the present embodiment.
Figure 27B:
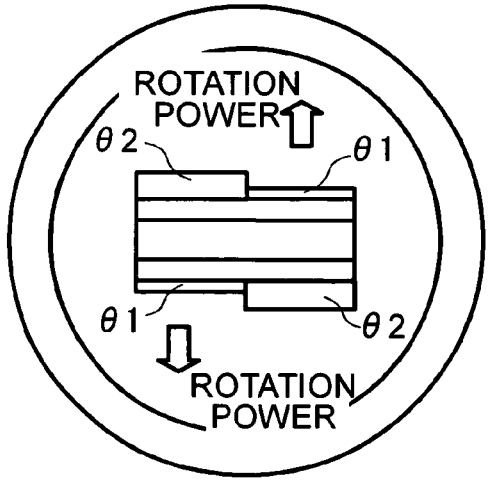

Next, further other embodiment according to the present Invention will be explained, by referring to FIGS. 27(A) and 27(B).

The configuration of the fluidic device according to the present embodiment is basically similar to that of the fluidic device shown in FIG. 10, however it has a feature in the shape of the fluid jet nozzle 3. In more details, it is constructed being symmetric with respect to the axis, so that θ1 and θ2 can be reversed or turned around the center on a boarder while setting any one of the nozzles to be θ1 in the opening angle, while the other to be θ2. In a case where the θ2 >θ1 as shown in the figure, the jet stream can easily flow towards the lower side in the figure, and as a result of this, reaction force is generated on the partition wall 14 directing upward.

In case of being constructed being symmetric to the axis, as is in the present embodiment, this reaction force turns to be rotating force for rotating the partition wall 14 into the counter clock-wise direction. Holding the partition wall 14 under the condition of being rotatable, by means of the attachment parts 16 and 17, enables the fluidic device to rotate around as a whole. As a result of this, it is possible to produce the flow oscillating within a wider range.

However, thought there is only described the air shower, as the example, into which is applied the fluidic device according to the present invention, but it is also applicable to the products relating to fluid accompanying jet stream, in general. In particular, it is suitable to be control the fluid under the circumstances of high temperature, low temperature, etc., under which it is difficult to construct the moveable mechanism. For example, there can be considered applications thereof into, such as, a jet bus, an air conditioner, a refrigerator, a heating cooking apparatus, a dishwasher, a dryer, a refrigerating machine, a combustion machine, a sprinkler, a mixer, etc.

According to the present invention, the resistance is reduced in the flow passage in the connector duct, and the flow is enhanced, flowing out to the point A and the point B, therefore it is possible to provide the fluidic device being able to oscillate with stability even if being made small in the sizes thereof.

The present invention may be embodied in other specific forms without departing from the spirit or essential feature or characteristics thereof. The present embodiment(s) is/are therefore to be considered in all respects as illustrative and not restrictive, the scope of the invention being indicated by the appended claims rather than by the forgoing description and range of equivalency of the claims are therefore to be embraces therein.

What is claimed is:

1. A fluidic device, comprising:

a fluid inflow opening;

a connector duct; and a fluid jet nozzle portion, wherein fluid flow within said connector duct is driven by a pressure difference at said fluid jet nozzle portion, said pressure difference being reversed as a result of fluid flow, and again being driven, thereby oscillating, and further said connector duct is constructed with curved surfaces delimiting two pieces of flow passages that are symmetric with respect to each other;

wherein said two pieces of flow passages are joined at a joining portion of said connector duct, so as to increase the velocity of the fluid flowing out of said fluid jet nozzle portion.

2. A fluidic device, comprising:

a fluid flow opening;

a connector duct; and a fluid jet nozzle portion, wherein fluid flow within said connector duct is driven by a pressure difference at said fluid jet nozzle portion, said pressure difference being reversed as a result of fluid flow, and again being driven, thereby oscillating, and further said connector duct is constructed with a plural number of flow passages;

wherein said connector duct is made of curved surfaces delimiting two pieces of flow passages, being symmetric with each other, and said fluid inflow opening and said fluid jet nozzle portion are disposed in a center between said two pieces of flow passages; and wherein said two pieces of flow passages are joined at a joining portion of said connector duct, so as to increase the velocity of the fluid flowing out of said fluid jet nozzle portion.

3. The fluidic device, as described in the claim 1, wherein said connector duct is constructed with a wind guiding plate.

4. The fluidic device, as described in the claim 2, wherein said connector duct is constructed with a wind guiding plate.

5. The fluidic device, as described in claim 1, wherein a guide vane is provided within said connector duct.

6. The fluidic device, as described in the claim 1, wherein said connector duct is constructed with a space defined between a connector duct reverse plate and a connector duct front plate, and said fluid inflow opening is formed on said connector duct reverse plate while said fluid jet nozzle portion is provided on said connector duct front plate.

7. The fluidic device, as described in the claim 4, wherein said connector duct is constructed with a space defined between a connector duct reverse plate and a connector duct front plate, and said fluid inflow opening is formed on said connector duct reverse plate while said fluid jet nozzle portion is provided on said connector duct front plate.

8. The fluidic device, as described in the claim 1, further comprising a partition wall in a cylindrical shape, being connected to said fluid jet nozzle portion.

9. The fluidic device, as described in the claim 4, further comprising a partition wall in a cylindrical shape, being connected to said fluid jet nozzle portion.

10. The fluidic device, as described in the claim 8, wherein said partition wall has an air hole therein.

11. The fluidic device, as described in the claim 9, wherein said partition wall has an air hole therein.

12. The fluidic device, as described in the claim 1, wherein said fluid jet nozzle portion is smaller at an upstream part in the direction of the fluid flow than at a downstream part in cross-section area thereof.

13. The fluidic device, as described in the claim 4, wherein said fluid jet nozzle portion is smaller at an upstream part in the direction of the fluid flow than at a downstream part in cross-section area thereof.

14. The fluidic device, as described in claim 1, wherein said fluid inflow opening, said connector duct, and said fluid jet nozzle portion are installed within a housing in a cylindrical shape or in a spherical shape.

15. The fluidic device, as described in claim 3, wherein the wind guiding plate has a curved surface.

16. The fluidic device, as described in claim 4, wherein the wind guiding plate has a curved surface.

17. The fluidic device according to claim 1, wherein said connector duct is configured with a first portion and a second portion including a reverse plate of said connector duct and a front plate of said connector duct, wherein said first portion and said second portion are fixed to each other.

18. The fluidic device according to claim 2, wherein said connector duct is configured with a first portion and a second portion including a reverse plate of said connector duct and a front plate of said connector duct, wherein said first portion and said second portion are fixed to each other.

19. The fluidic device according to claim 1, wherein said fluid jet nozzle portion comprises part of an air shower apparatus.

20. The fluidic device according to claim 2, wherein said fluid jet nozzle portion comprises part of an air shower apparatus.

* * * * *